US005393281A

United States Patent [19]

Chen

[11] Patent Number: 5,393,281

[45] Date of Patent: Feb. 28, 1995

[54] INDICATOR FOR AN EXERCISING APPARATUS WITH A ROTATING MEANS

[76] Inventor: Paul Chen, No. 3-6, Ching Yang Rd., Liu Pao Village, Ta Ya Hsiang, Taichung Hsien, Taiwan, Prov. of China

[21] Appl. No.: 213,493

[22] Filed: Mar. 15, 1994

[51] Int. Cl.[6] ..... A63B 23/00; G01F 1/22

[52] U.S. Cl. ..... 482/57; 482/909; 482/13; 73/861.55; 73/379.09

[58] Field of Search ..... 482/13, 57, 909, 59; 73/379.01, 379.07, 379.09, 861.55, 861.57

[56] References Cited

U.S. PATENT DOCUMENTS 4,579,124 4/1986 Jentges ..... 482/909

4,579,335 4/1986 Centafanti ..... 73/379.09

4,944,306 7/1990 Alvino ..... 128/725

*Primary Examiner*—Stephen R. Crow

*Attorney, Agent, or Firm*—Townsend and Townsend Khourie and Crew

[57] ABSTRACT

A indicator for an exercising apparatus with a rotating element includes a base, a cover being engaged with the base, a blowing device being disposed on the base, a transmission device having a first end connected to the rotating device of the exercising apparatus and a second end engaged to the blowing device for actuating the blowing device and a float being disposed in the cover and above the blowing device. The float can be propelled upwardly when the blowing device is actuated.

13 Claims, 2 Drawing Sheets

INDICATOR FOR AN EXERCISING APPARATUS WITH A ROTATING MEANS

The present invention relates to a indicator for an exercising apparatus with a rotating means and more particularly, to an indicator with a fan and a float disposed therein for providing an entertaining function.

A conventional indicator used on:exercising apparatus is a dial with a hand similar to one of the hands of a clock, the hand is a needle type element which is pivotally engaged in the dial providing a feature of indicating a numeral marked on a scale of the dial. However, such an indicator maintains its own specified manner to show the information by swinging the hand to a corresponding numeral of the scale, in other words, such a manner cannot provide vigorous, interesting or even entertaining effects to the user. In addition, the indicator always has a monotonous configuration which results in boredom when using an exercising apparatus.

SUMMARY OF THE INVENTION

According to one aspect of the present invention which provides an indicator for an exercising apparatus with a rotating means, and which includes a base having a blowing means disposed thereon, an transparent cover is mounted on the base and a float is disposed within the cover. A transmission means having two ends is connected to the rotating means and the blowing means respectively. The blowing means is actuated by the transmission means via operating the rotating means of the exercising apparatus to propel the float upwardly.

It is an object of the present invention to provide a visual entertaining function on an indicator for an exercising apparatus. A float is propelled upwardly by a fan disposed in the indicator which is actuated by means of operating the rotating means of the exercising apparatus.

Further objects, advantages, and novel features of the invention will become more apparent from the following detailed description when taken in conjunction with the accompanying drawings.

DETAILED DESCRIPTION OF THE PREFERRED EMBODIMENTS

Figure 2:
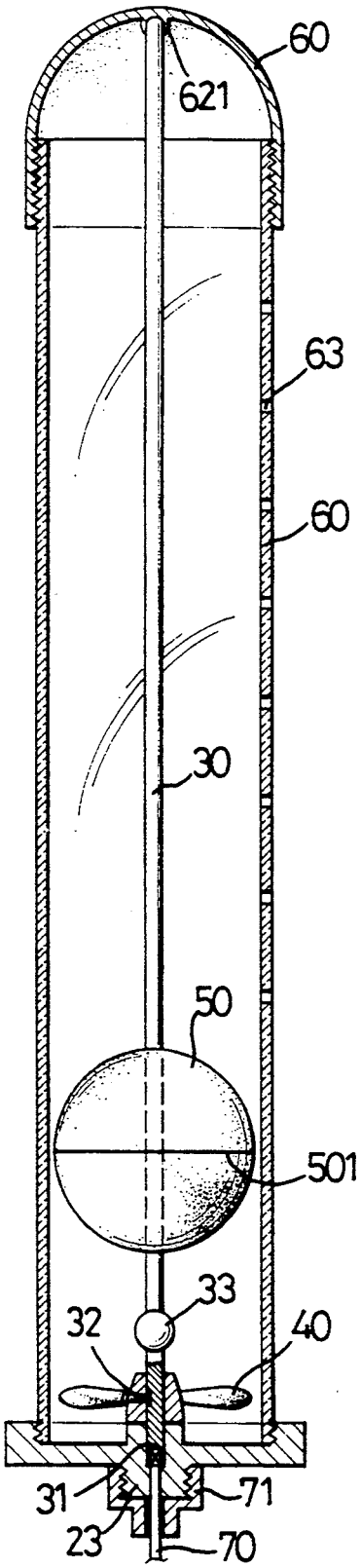
FIG. 2 is a side elevational view, partly in section, of the indicator in accordance with the present invention.
Figure 1:
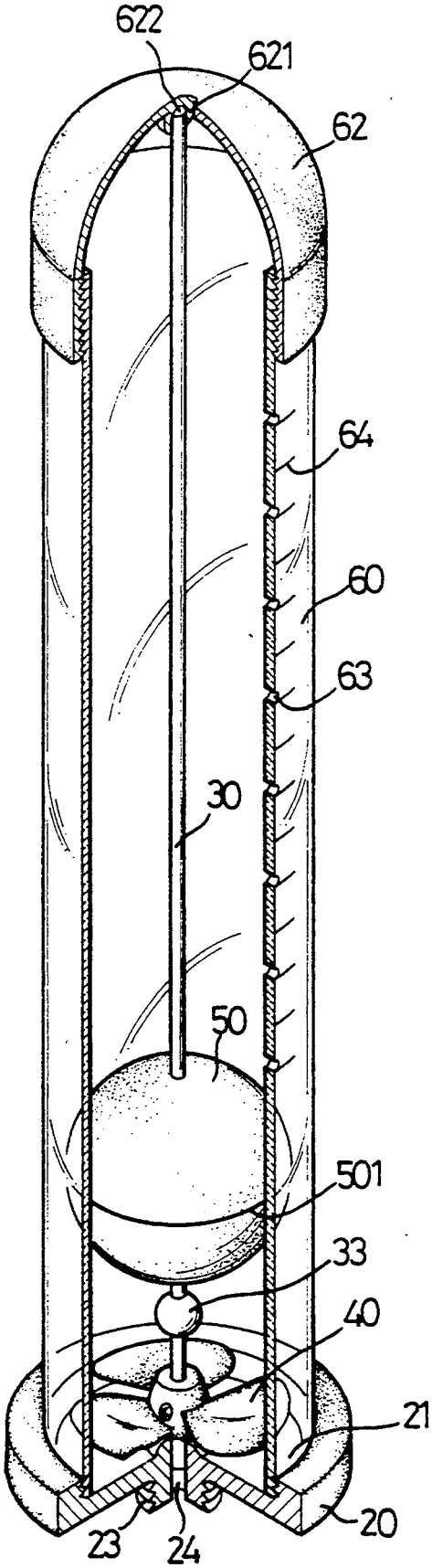
FIG. 1 is a perspective view partly in section of an indicator in accordance with the present invention.

Referring to the drawings and initially to FIGS. 1 and 2, an indicator 10 in accordance with one aspect of the present invention generally includes a base 20, a rod 30, a fan 40, a float 50 and a cover 60. The base 20 has an upper side and an under side, wherein the upper side has a recess 21 defined therein in which a thread portion is formed in a vertical peripheral surface thereof and the under side has a threaded projection 23 projecting therefrom and with a through hole 24 defined therein for communicating to the recess 21.

The rod 30 having upper and lower ends extends through the hole 24, a reception hole 31 is defined in the lower end of the rod 30 for engaging to a transmission means, a cable 70 for example, and rotating therewith. Furthermore, the rod 30 has a recess 32 therein defined by a base and a periphery near a lower end thereof. The cable 70 has first and second ends, the second end thereof is connected to a rotating means 80 (FIG. 3) by a gear set (not shown) and has a certain proportional r.p.m. to that of a rotating means 80, the first end thereof is inserted into the reception hole 31 of the rod 30 with a socket 71 threadedly engaged to the projection 23. The fan 40 is fixedly mounted to the lower end of the rod 30 by threading a bolt through the fan 40, a tip of the bolt contacting against the base defining the recess 32 defined in the rod 30. The float 50 having a center hole is slidably mounted on the rod 30 and is stopped by a protuberance 33 which radially projects from the rod 30 and is located above the fan 40.

The cover 60 is made of transparent material and has first and second ends, the second end thereof has an outer threaded portion for threadedly engaging to the threaded portion of the base 20 and the first end thereof engages to a cap 62 by a similar threading manner. The cap 62 has a boss 621 formed in an under side thereof in which a recess 622 is defined for reception of the first end of the rod 30. The cover 60 has an inner space which is large enough for allowing the float 50 to move up and down along the rod 30, a plurality of holes 63 are defined in the cover 60 for communicating with the atmosphere and a plurality of scales 64 are marked on the cover 60 for indicating user's energy input by aligning with an indicating line 501 marked on a diametrical peripheral surface of the float 50.

Figure 3:
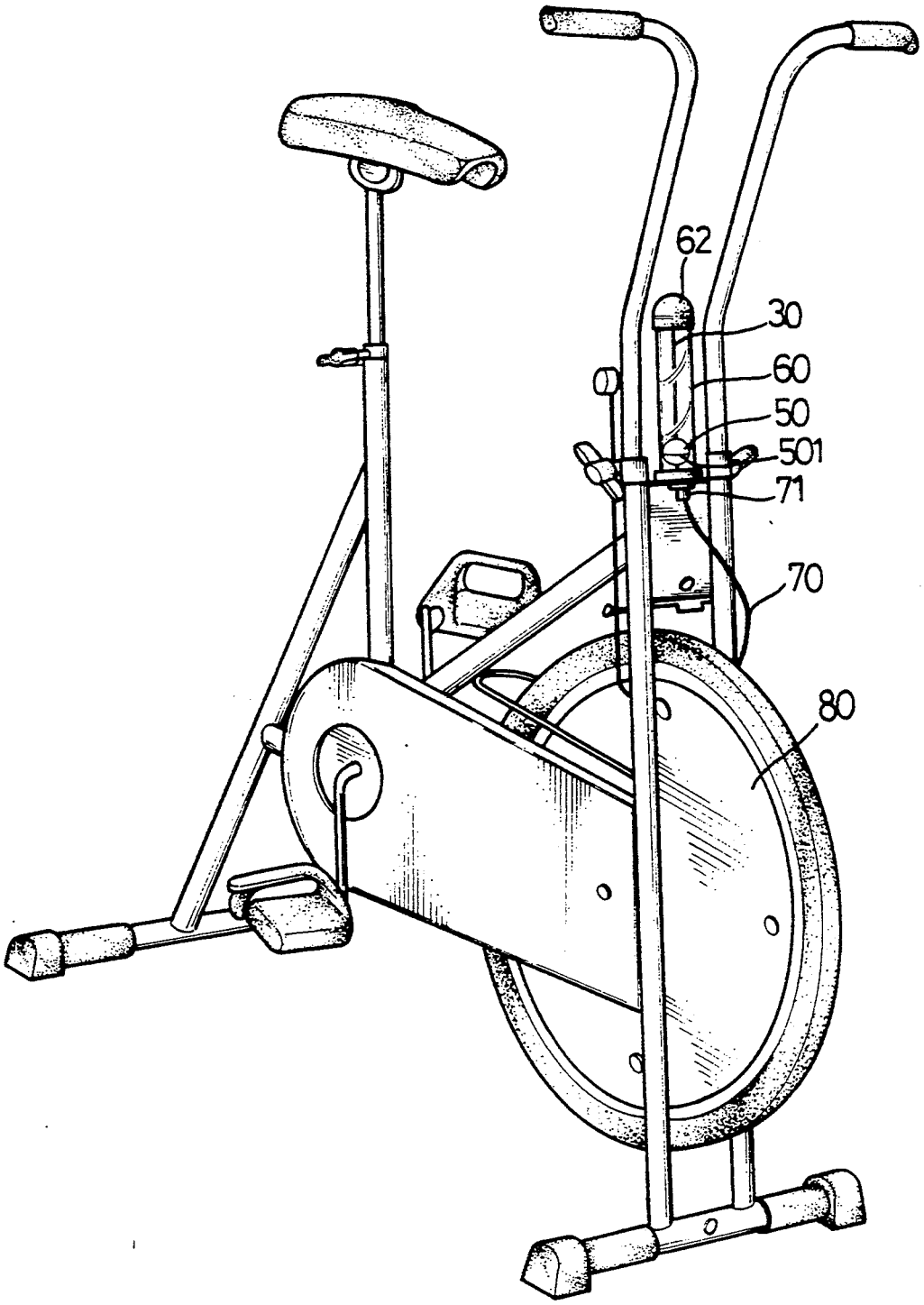
FIG. 3 is a perspective view of the indicator in accordance with the present invention, which is disposed on an exercising apparatus.

Referring now to FIG. 3, when using an exercising apparatus, a user operates the rotating means 80 to rotate about an axle thereof and the cable 70 connected thereto is then co-rotated with the rod 30 at a proportional r.p.m. to that of the rotating means 80 through the gear set. The fan 40 (not shown here) fixedly engaged to the rod 30 rotates and blows the float 50 up along the rod 30, the height of the float 50 to be blown is according to the r.p.m. of the fan 40. Therefore, user can entertainingly observe the movement of the float 50 and then he or she realizes how much energy has been inputted.

Accordingly, the present invention provides an indicator which is absolutely different from those available conventionally, and the way of displaying message of energy inputted is visual and entertaining.

Although the invention has been explained in relation to its preferred embodiment, it is to be understood that many other possible modifications and variations, such as the transmission means of another embodiment of the present invention which comprises a rechargeable battery which is charged by actuating the rotating means 80 to actuate the fan 40 to blow the float 50, can be made without departing from the spirit and scope of the invention as hereinafter claimed.

I claim:

1. An indicator for an exercising apparatus with a rotating means comprising:

a base;

a cover being engaged with said base;

a blowing means being disposed on said base;

a transmission means having a first end connected to said rotating means of said exercising apparatus and a second end engaged to said blowing means for actuating said blowing means; and a float disposed in said cover and above said blowing means, and which can be propelled upwardly when said blowing means is actuated.

2. An indicator for an exercising apparatus with a rotating means comprising:

a base having a through hole defined therein;

a rod having upper and lower ends and extending through said through hole, a fan being fixedly mounted to said lower end of said rod to rotate therewith, a float having a center hole and being slidably mounted on said rod;

a cover engaged to said base and having an inner space large enough for allowing said float to move therein;

a transmission means having a first end engaged to said second end of said rod and a second end engaged to said rotating means for rotating said rod and said fan thereby propelling said float upwards along said rod.

3. The indicator as claimed in claim 2 wherein said base has an upper side and an under side, a threaded projection extending from said under side thereof.

4. The indicator as claimed in claim 2 wherein said transmission means is a cable.

5. The indicator as claimed in claim 2 wherein said lower end of said rod has a reception hole defined therein for engaging said first end of said transmission means and rotating therewith.

6. The indicator as claimed in claim 2 wherein said rod has a protuberance projecting therefrom and located above said fan.

7. The indicator as claimed in claim 2 wherein said cover is made of transparent material.

8. The indicator as claimed in claim 2 wherein said cover has first and second ends, a cap being threadedly engaged to said first end thereof.

9. The indicator as claimed in claim 2 wherein said first end of said cover has a reception means formed on an inner side thereof.

10. The indicator as claimed in claim 9 wherein said cap has a boss formed in an inner side thereof and a recess is defined therein for reception of said upper end of said rod.

11. The indicator as claimed in claim 2 wherein said cover has a plurality of holes formed therein for communicating with the atmosphere.

12. The indicator as claimed in claim 2 wherein said cover has a scale marked thereon.

13. The indicator as claimed in claim 2 wherein said float has an indicating line marked on a diametrical peripheral surface thereof.

* * * * *